US005652988A

United States Patent [19]

Appelhoff

[11] Patent Number: 5,652,988

[45] Date of Patent: Aug. 5, 1997

[54] MULTIFUNCTIONAL HAND-HELD DEVICE

[76] Inventor: Hubert Appelhoff, Auf dem Büchel 53, D-53925 Kall, Germany

[21] Appl. No.: 537,763

[22] PCT Filed: Apr. 14, 1994

[86] PCT No.: PCT/EP94/01150

§ 371 Date: Oct. 20, 1995

§ 102(e) Date: Oct. 20, 1995

[87] PCT Pub. No.: WO94/23907

PCT Pub. Date: Oct. 27, 1994

[30] Foreign Application Priority Data

Apr. 20, 1993 [DE] Germany ..... 9305864 U
Feb. 14, 1994 [DE] Germany ..... 9402401 U

[51] Int. Cl.[6] ..... B67B 7/00

[52] U.S. Cl. ..... 7/151; 7/169; 81/437

[58] Field of Search ..... 7/106, 138, 151, 7/169; 81/437

[56] References Cited

U.S. PATENT DOCUMENTS 66,643 7/1867 Shepard ..... 7/138
850,319 4/1907 Robinson ..... 7/138 X
898,839 9/1908 Davitt et al. ..... 7/138
1,889,556 11/1932 Lane .
2,802,259 8/1957 Stoner .
3,461,469 8/1969 Morrision .
4,580,469 4/1986 Lordahl .

FOREIGN PATENT DOCUMENTS 510236 4/1921 France .
2125289 11/1972 Germany .

*Primary Examiner*—James G. Smith
*Attorney, Agent, or Firm*—Antonelli, Terry, Stout & Kraus, LLP

[57] ABSTRACT

A multifunctional hand-held device has a plate-like body around the circumference of which are shaped various tools which project from the body. Other tools having different functions are formed by recesses or indentations arranged around the circumference and formed in the plate-like body. An embodiment of the hand-held device looks approximately like a frog with a head, a neck and two legs. The device is made of metal.

19 Claims, 4 Drawing Sheets

Fig. 1
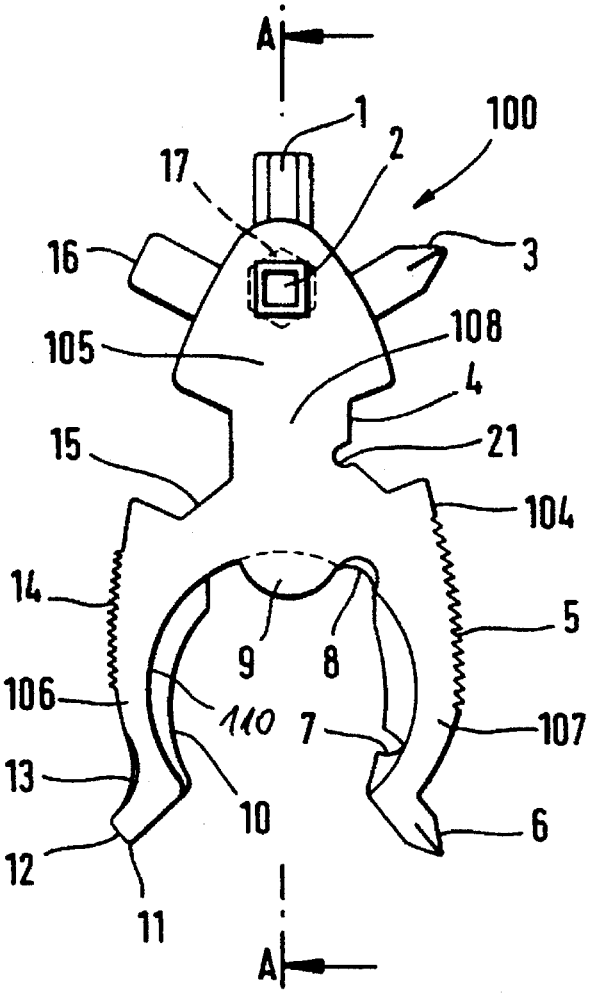
Fig. 2
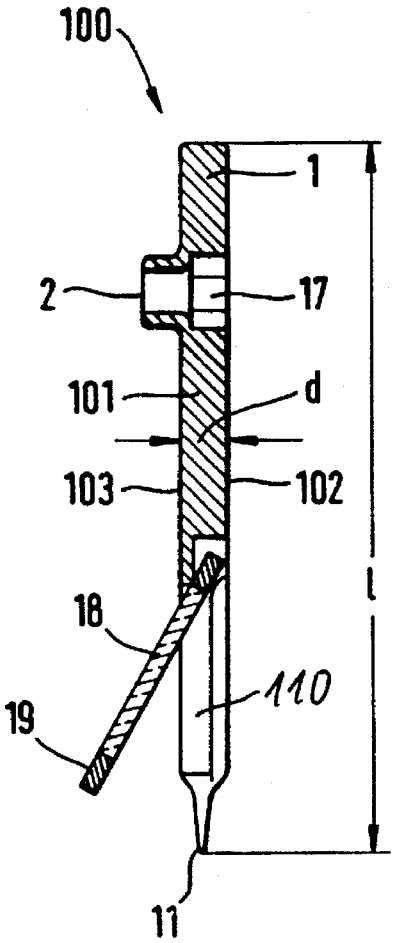
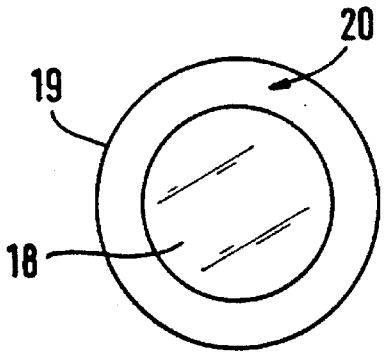
Fig. 3

Fig. 5
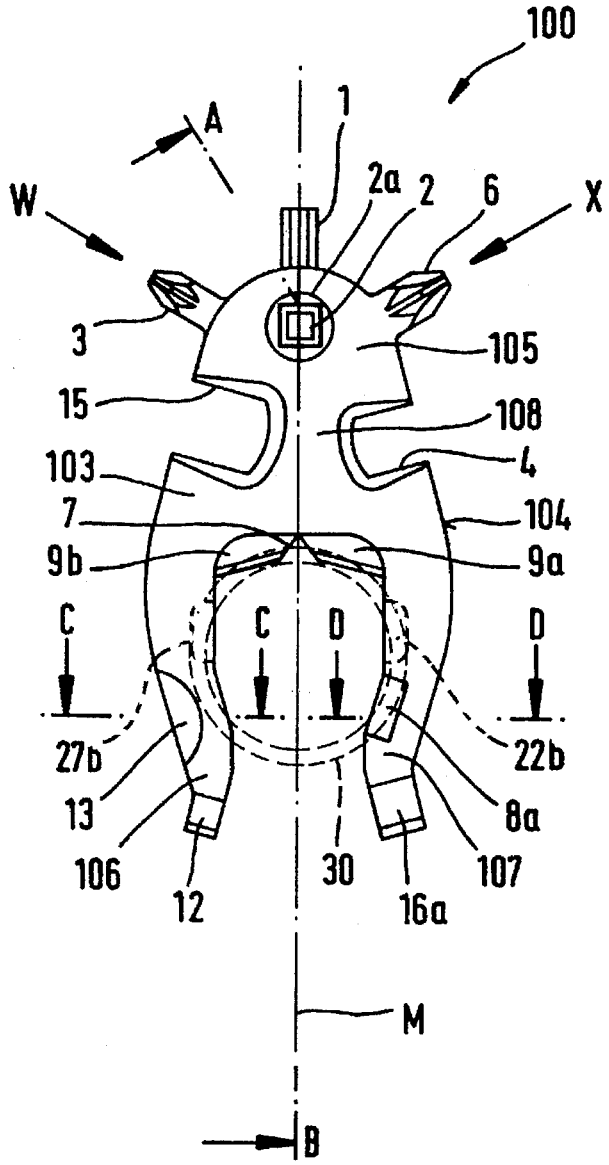
Fig. 11
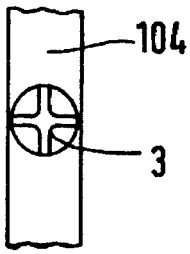
Fig. 10
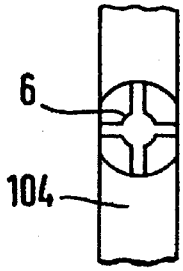
Fig. 8
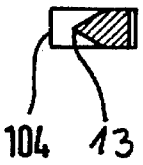
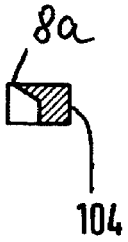
Fig. 9

Fig. 12
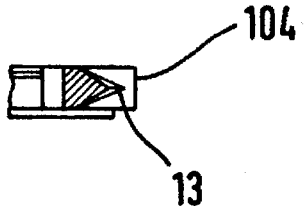
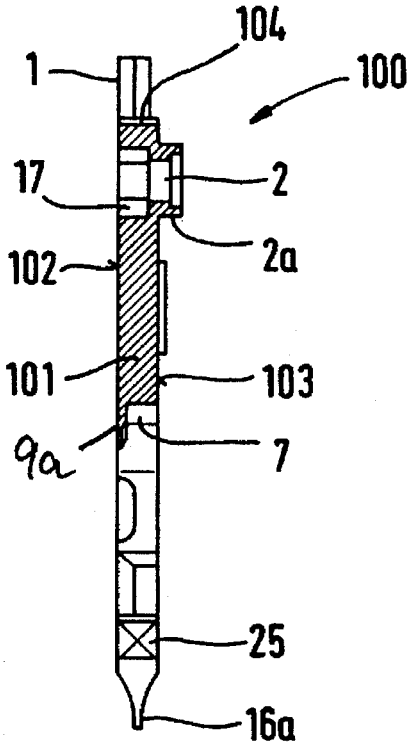
Fig. 6
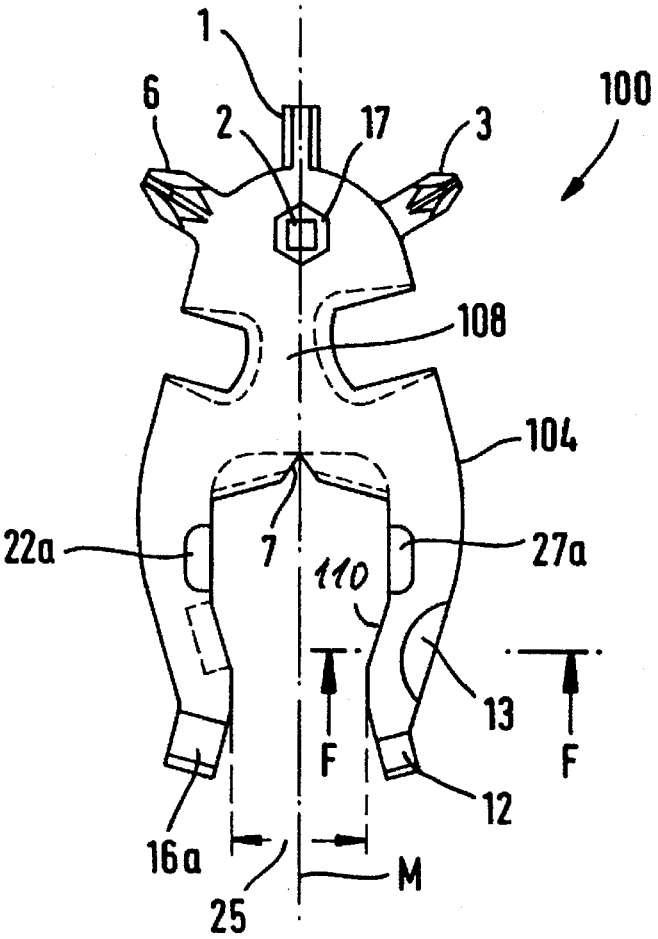
Fig. 7

MULTIFUNCTIONAL HAND-HELD DEVICE

The invention relates to a multifunctional hand-held device with a plate-shaped body having a top, a bottom, and a narrow circumferential side in which various tools are provided on the circumferential side of the plate-shaped body and project beyond the circumferential side, and other tools with various functions are provided by means of molded indentations.

A multifunctional hand-held tool according to the species is known for example from FR-A-510236. The basic plate-shaped body is formed lengthwise in the manner of a handle and with indentations for a gauge or wrench and possibly with cutting edges, hooks, and a screwdriver.

It is a relatively long hand tool that is to large to be carried continuously in a pants pocket.

Multifunctional hand-held devices are also wrenches such as double open-ended wrenches, but which have several tools for the same function. DE-A-2125289 teaches a plate-shaped approximately circular screwdriver with a plurality of open-ended recesses of different sizes on the circumference.

The goal of the invention is to provide a multifunctional hand-held tool of a small size so that it can be carried in any purse or pants pocket, said device having tools for many functions required for daily needs.

To achieve this goal the invention proposes designing a multifunctional hand-held device according to the species in such fashion that the plate-shaped body has a frog-like shape with a head part, neck part, and two legs, with the neck part being formed by two indentations for tools located approximately opposite one another and the legs by an approximately semicircular indentation.

The multifunctional hand-held device according to the invention is manufactured in particular from a high-strength metal, such as titanium or stainless steel, V2-A steel, chromium-vanadium steel, especially as a casting, in a handy size a few centimeters wide, so that it can be carried comfortably in any pants pocket, jacket pocket, or purse. The hand-held device is then available as a "emergency tool" everywhere and for every situation, when normal standard tools are not accessible. To ensure sufficient strength, the hand-held device is preferably made from a hardenable metal that is hardened after shaping. Each tool formed on the hand-held device is functional and completely weight-bearing, since the hand-held device is made of a high-strength material.

Advantageous embodiments and improvements on the invention are contained in the characterizing features of subclaims 2 to 18. In particular, it is proposed to equip the multifunctional hand-held device with at least an Allen wrench, a socket wrench for venting radiators, a Phillips screwdriver, an open-ended wrench, a bottle opener, a fingernail cleaner, a flat-blade screwdriver, and a box-end wrench. Preferably all of these tools are made integral with the hand-held device, i.e. on the plate-shaped body. In addition, corners suitable as bottle openers and functions for a faucet filter/aerator can be provided. In addition, tools such as a wood file, nail cleaner, knife blade, and nail file can be provided.

The hand-held device according to the invention with multiple functions in the form of the various tools formed on it can be made for example by pressure diecasting from a high-strength metal. It is also possible to make the hand-held device from a high-strength, possibly fiber-reinforced plastic. a matching disk can be gasped between the legs. A disk of this kind can be equipped for example with a magnifying glass that is then available as a seeing aid. In an improvement on the invention, the indentation that forms the free space between the legs is made in the form of a bottle opener.

On the head part of the plate-shaped body, tools are formed that preferably project beyond the circumferential side and possibly beyond the top as well, for example an Allen wrench, a socket wrench, a flat-blade screwdriver, and/or a Phillips screwdriver. The bottom of the hand-held device is preferably made smooth and flat.

A box-end wrench can be fitted into the plate-shaped body in the vicinity of the head part from the bottom and can be made as a through hole, connected with and coaxial with a tubular box wrench formed in a bushing molded on the top of the head part of the plate-shaped body. Open-end wrenches are preferably provided according to the invention on the plate-shaped body in the form of indentations. By designing the plate-shaped body with an approximately arcuate recess, the circumferential side is enlarged by designing the legs so that numerous tools such as nail files and wood files can be formed in these areas on the circumferential sides and nail claws, knives, and cutting edges can be formed where they are protected on the inner circumferential sides of the legs. In addition, the ends of the legs of the plate-shaped body can be designed as Phillips screwdrivers and/or flat-blade screwdrivers.

The approximately arcuate space formed between the two legs of the plate-shaped body can also be used in conjunction with at least one of the tabs formed in the area of the vertex of the indentation as a bottle opener. With a diameter of the arc of a suitable size, a mark coin or token or the like or a disk containing a magnifying glass can be inserted.

The multifunctional hand-held device proposed according to the invention makes it possible immediately to perform activities to meet daily needs, for example tightening a bolt on a bicycle while on the road, venting radiators, tightening screws that suddenly loosen, or for example to file down wood splinters that have formed, at least on an emergency basis in those cases when the normal hand tool is not available.

The invention will be described in the drawing with reference to the embodiments.

FIG. 1 is a top view of the multifunctional hand-held device.

FIG. 2 shows Section AA in FIG. 1.

FIG. 3 is a top view of a disk insertable into the hand-held device according to FIG. 1, as indicated in FIG. 2.

FIG. 5 is a top view of another version of a multifunctional hand-held device.

FIG. 6 shows Section AB in FIG. 5.

FIG. 7 is a bottom view of the hand-held device according to FIG. 5.

FIG. 8 shows Section CC in FIG. 5.

FIG. 9 shows Section DD in FIG. 5.

FIG. 10 shows view X enlarged according to FIG. 5.

FIG. 11 shows view W enlarged according to FIG. 5.

FIG. 12 shows Section FF according to FIG. 7.

Figure 4:
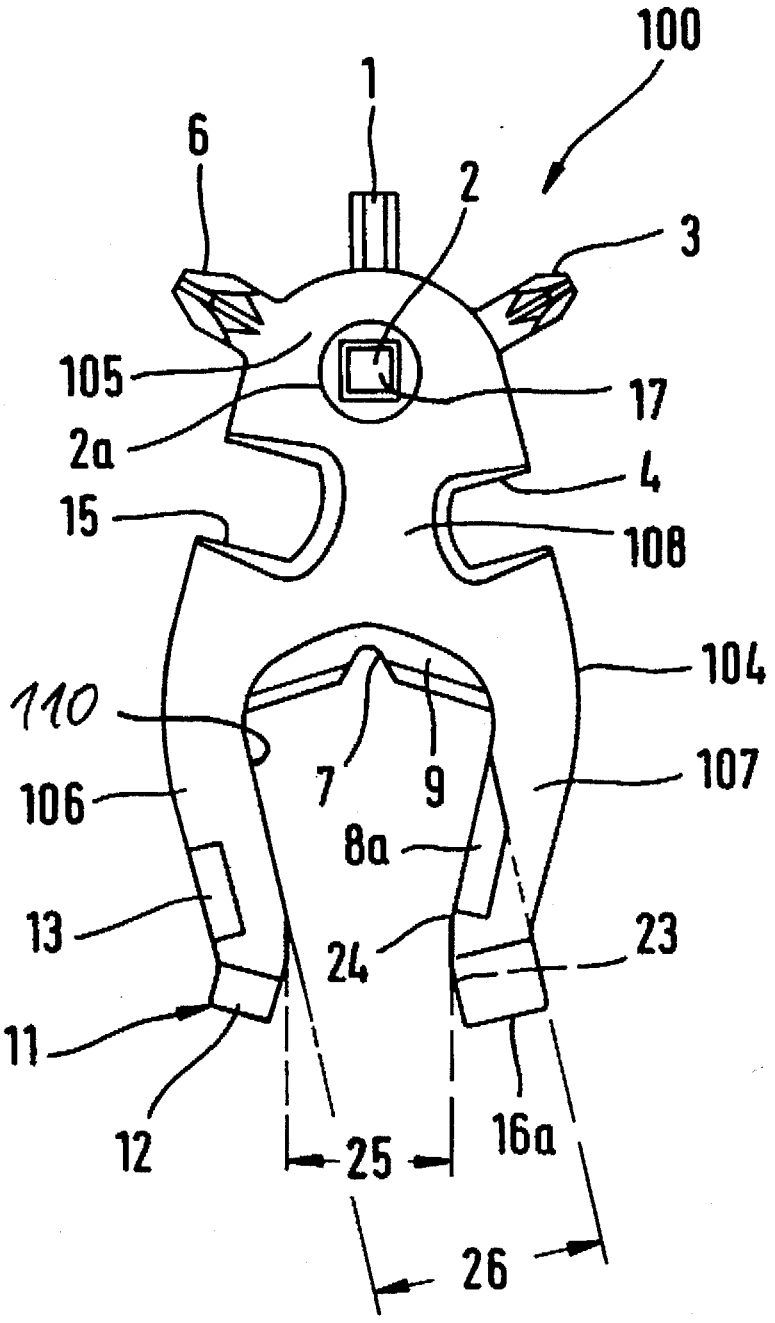
FIG. 4 is a top view of the top of another version of a multifunctional hand-held device.

Multifunctional hand-held device 100 according to FIGS. 1 and 2 for various tool functions consists of a plate-shaped body 101, made for example of a high-strength metal such as titanium or stainless steel. Plate-shaped body 101, in the top view in FIG. 1, has an approximately frog-shaped form with head part 105 and legs 106, 107, with a free space being formed between the legs by an end indentation or recess 110 that is more than semicircular. Head part 105 is separated from the legs by neck part 108, with the neck part being formed by lateral indentations 4, of different sizes located opposite one another. At least one of the sides, namely top 103 or bottom 102 of the plate-shaped body, is preferably made flat, and the narrow surrounding circumferential side 104 delimits the body laterally. Most of the tools formed on hand-held device 100 are formed on narrow circumferential side 104, preferably integrated with the plate-shaped body, either molded so that they project beyond the circumference or formed by indentations on the plate-shaped body. Head part 105, which is approximately half-round to oval or triangular, has tools projecting from circumferential side 104 and extending in the plane of the plate, in the form of an Allen wrench 1, for example 4 mm in size, a Phillips screwdriver (size 2) and a flat-blade screwdriver 16. The transition from head part 105 to legs 106, 107 is constricted neckwise at part 108 by two lateral indentations located opposite one another on the circumferential side which are designed as tools in the form of an open-end wrench 15, with a 10 mm opening for example, and an open-end wrench 4 with an 8 mm opening. In addition, in the vicinity of one of the open-end wrenches, in this case open-end wrench 4, a nail claw 21 can also be formed in the circumferential side. In the vicinity of head part 105, a projecting bushing **2*a* can be provided on top 103, said bushing being formed as a tubular socket wrench 2 for use as a radiator-venting wrench 5 mm in diameter. Coaxially thereto, the recess of the tubular socket wrench can be formed continuously by plate-shaped body 101 and enlarged on the opposite side as a box-end wrench 17** with a diameter of 6 mm.

In the vicinity of the outer sides of legs 106, 107 the circumferential side can be made areawise as a wood file 5 with suitable ridges for example and as a nail file 14 with suitable teeth. By providing a suitable slightly curved shape to the legs, these file surfaces can easily be put to practical use.

At the ends of legs 106, 107, suitable tools such as a Phillips screwdriver 6 or a flat-blade screwdriver 12 can be formed. In the vicinity of the flat-blade screwdriver and adjacent thereto, the circumferential side can be made to have edges, for example an edge 11 for a fingernail cleaner and, opposite thereto, as a blunt edge 13 for opening letters, packages, or the like. None of the tools formed on the outer circumference of body 101 should have sharp edges, in order to avoid injury when using them. In the vicinity of circular a opening provided by the end indentation 110 between legs 106, 107, projecting edges 10 can be provided for use as a wire cutter. These edges 10 are made with a thickness less than that of body 101, so that a supporting surface is created for a disk 19 to be placed in the circular opening; see FIGS. 2 and 3. In the vicinity of the vertex of the circular recess between legs 106, 107, a projecting tab 9 is formed, likewise with a thickness less than the wall thickness of body 101 on the circumferential side. This tab 9 serves as a bottle opener and simultaneously as a supporting surface for disk 19. In addition, cutting tools can be formed along the circumferential side of the plate-shaped body in the vicinity of circular recess 110, for example a cutting edge 8 to serve as a small knife for cutting thread or as a nail cleaner 7.

Disk 19 for example can be a token or a coin or even a disk with a built-in magnifying glass 18. The diameter of the circular recess can be about 23.5 mm for example, so that a disk 19 which is only slightly larger can be placed and gripped firmly between legs 106, 107. Disk 19, as shown in FIG. 2, can then be removed on one side from the circular opening and body 101.

It is also possible to place information on the top and bottom of hand-held device 100, and on the edge of disk 19 as well. For example, the latter can be lettered with the words "yes" and "no" on the front and back in order to be used as an aid to making decisions by tossing it.

The total length 1 of the multifunctional hand-held device according to FIGS. 1 and 2, measured between the ends of the legs and the Allen wrench 1 projecting at the head part, can be kept small, especially 6 to 9 cm. The total width of the hand-held device, measured between the outsides of legs 106, 107, can be kept to 3 to 5 cm, and the thickness d of the plate-shaped body can be 4 to 5 mm to produce a very small hand-held device and a hand-held device that can be carried along at all times for daily use.

The hand-held device shown in FIGS. 1 and 2 can also be equipped with fewer tools or in another embodiment, with new tools.

In FIG. 4, in a top view, another version of the multifunctional hand-held device is shown. Here again, the basic form of hand-held device 100 is in the shape of a frog with head part 105, neck part 108 formed by two indentations located opposite one another and each forming an open-end wrench 4, 15 of a different size, and two legs 106, 107 connected thereto and slightly spread outward, said legs enclosing a free space provided by indentation 110 between them. The ends of the two legs 106, 107 are angled outward slightly. Head part 105 is rounded and has tools along its circumferential side 104 with sufficient space between them, in the form of an Allen wrench 1 and two Phillips screwdrivers 3, 6 of different sizes. In the central area of head part 105, again on the underside of the plate, there is a recess 17 to be used as a socket wrench which, as can be seen in FIG. 2, terminates on the other side in a projecting bushing **2*a*, designed as a radiator venting wrench. On the insides of the two legs 106, 107, in the central circumferential area shaped in an arcuate fashion, a projecting tab 9 is formed which serves as a bottle opener. An indentation 7 can also be provided in this tab that can be used as a nail claw. Along the inside or outside of legs 106, 107 blunt edges 13, 23, and 8*a* can be formed that can be used as package or letter openers. If the edge 8*a* extends along the inside of a leg, it can also be made with a slightly sharper edge for use as a knife, so that threads can be cut, since hand-held device 100 is grasped only on the outside of the legs by a hand. A blunt corner 24, which can serve for example as a can opener for milk cans or the like, can be formed at the ends of the legs in the transitional area from a knife edge 8*a* to the inside of a leg 107. At the ends of legs 106, 107, flat-blade screwdrivers 12, 16 with larger and smaller dimensions can preferably be provided. With suitable parallel guidance of the insides of legs 106, 107 in partial areas it is possible, as shown by the dashed lines indicating distance 25, to produce an opening in the form of an open-end wrench with an opening that differs from open-end wrenches 4, 15, especially a larger opening. With an appropriate arrangement of the inside edges of legs 106, 107 in the middle area, as indicated by reference numeral 26, a wrench for a faucet filter/aerator can be formed like that used for faucets, the circumferential side, produced in the vicinity of knife edge 8*a*** by tapering being included.

The multifunctional hand-held device 100 according to FIG. 4 also shows how suitable tools can be formed, preferably along the circumferential sides of the frog-shaped body, which enable the user to perform a wide variety of tasks with only one device. Sharp edges are provided by locating them on the insides of the legs where they are protected, preventing injury when using the device. Plate-shaped body 101 has sufficient weight for the molded tools to be stable and strong and to avoid bending of the body or the tools during use. At the same time, plate-shaped body 101 is shaped by indentations so that it is relatively light and easy to handle and can be carried in the pocket.

FIGS. 5 to 12 show another embodiment of a multifunctional hand-held device 100 according to the invention in several views. FIG. 5 shows hand-held device 100 in a top view of top 103 of the plate-shaped body in original size. FIG. 7 shows a bottom view of hand-held device 100, while FIG. 6 shows cross section AB in FIG. 5. Plate-shaped body 101, which has a nearly oval shape, is divided by two indentations opposite one another that form two open-end wrenches 4, 15 of different sizes, into a head part 105 and a neck part 108. On the opposite side of the head part, plate-shaped body 101 has a large end indentation 110 of a size that makes it usable as a bottle opener, in such fashion that two legs 106, 107 opposite one another are formed and indentation 110 is located on the end opposite head part 105. The ends of legs 106, 107 are angled slightly outward and shaped as flat-blade screwdrivers 12 and 16*a* of different sizes. On the outer circumference 104 of rounded head part 105, tools are formed that project and are spaced apart from one another at sufficient distances, namely an Allen wrench 1, for example size 4, in the middle and on each side Phillips tips 3 to 6 as screwdrivers of different sizes. On the top of head part 105, roughly at the center, an upwardly projecting bushing 2*a* with a square hole 2 is formed as a tubular socket wrench, for use as a radiator venting wrench for example. On the bottom of plate-shaped body and located coaxially with respect to tubular socket wrench 2 an annular opening 17 is provided in the shape of a hexagon that forms a box-end wrench as shown in FIG. 6.

The open-end wrenches 4 and 15 formed by indentations 4 are provided on top 103 of the plate-shaped body with a collar shape. Bottom 102 of the plate-shaped body is made flat and smooth, as also shown in FIG. 6, so that the hand-held device can lie flat.

FIG. 11 shows on a scale of 2:1, view W of the small Phillips screwdriver and FIG. 10 shows on a scale of 2:1, view X of the larger Phillips screwdriver 6.

The large indentation 110 between legs 106, 107 has a tab in the vicinity of its vertex that extends into the free space, divided by a notch 7 that can serve as a nail claw into two tabs 9*a*, 9*b*. Recess 110 together with tabs 9*a*, 9*b* can be used as a bottle opener, with the bottle cap indicated by the dashed lines in FIG. 5. In order to have sufficient freedom of movement to remove the bottle cap, legs 106, 107 have on the inside a wedge-shaped taper of the plate-shaped body on the underside corresponding to the areas marked 27*a*, 22*a* in an area adjoining tabs 9*a*,9*b*.

On the outer circumference of one of the legs, in this case leg 106, and near the end of the leg, the plate-shaped body is likewise tapered wedgewise outward to produce an edge 13 suitable for opening packages, letters or the like. This edge 13 is clearly visible in FIGS. 8 and 12.

Likewise, a knife edge 8*a* is evident on the inside of one leg, in this case leg 107, produced by a suitable recess as shown in FIGS. 5 and 9.

Both edge 13 and knife edge 8*a* are distanced by recesses from the outer edge, i.e. the outer circumferential side 104, see FIG. 8, and the inner circumferential edge in the vicinity of indentation 110, see FIG. 9, to prevent injury.

Hand-held device 100 is made in one piece from a high-strength material, especially metal, for example by the pressure die-casting method. Depending on the metal chosen, it may be possible to harden or temper the hand-held device further. It is also possible to provide a coating, for example a zinc coating, for the surfaces of the wrenches, screwdrivers, and blades or of other functional surfaces.

I claim:

1. Multifunctional hand-held device comprising a plate-shaped body having a top side, a bottom side, and a narrow circumferential side wherein various projecting tools are formed on the circumferential side of the plate-shaped body and project beyond the circumferential side, and additional tools with various functions are provided by molded indentations on the circumference side, said plate-shaped body having a frog-shaped configuration including a head part, a neck part, and two legs, said neck part being formed by two lateral indentations in the body located approximately opposite one another to provide tools in the form of open-end wrenches of different sizes and said two legs being formed by an end indentation that is roughly semicircular; said end indentation being located between said legs and providing a bottle opener in conjunction with at least one projecting tab formed on the circumferential side in the area of a vertex of said end indentation.

2. Hand-held device according to claim 1, wherein the head part has projecting tools in the form of an Allen wrench, a Phillips screwdriver and a flat-blade screwdriver.

3. Hand-held device according to claim 1, wherein a bushing projecting vertically from the plate-shaped body is formed as a tubular socket wrench on the top side of the plate-shaped body in a middle of the head part.

4. Hand-held device according to claim 3, wherein an opening is formed opposite to the recess that passes through the plate-shaped body to the bottom side and forms a box-end wrench as a coaxial extension of the tubular socket wrench.

5. Hand-held device according to claim 1, wherein a wood file is formed on an outer circumferential side of one leg of the plate-shaped body.

6. Hand-held device according to claim 1, wherein the ends of the legs are shaped as Phillips screwdrivers.

7. Hand-held device according to claim 1, wherein a blunt cutting edge is formed as a letter or package opener by a wedge-shaped tapering of plate-shaped body at an end of one of the legs on an outer circumferential side adjoining one of the screwdrivers, by a partial area of the one leg.

8. Hand-held device according to claim 1, wherein a partial area on an inside of at least one of the legs of the plate-shaped body in the vicinity of said end indentation is formed as a cutting edge for a knife.

9. Hand-held device according to claim 1, wherein a blunt edge is formed along an inner circumferential side of one leg, said edge being suitable as a letter opener and being formed in a corner suitable as a letter opener in transition to a cutting edge on the one leg that serves as a knife.

10. Hand-held device according to claim 1, wherein a free space formed between the inner circumferential sides of legs by the end indentation in a starting area forms an open-end wrench of a specific size by parallel guidance of insides of the legs.

11. Hand-held device according to claim 1, wherein a faucet filter-aerator wrench of a specific size is formed between inner circumferential sides of the legs by section-wise parallel guidance of sides opposite one another.

12. Hand-held device according to claim 1, wherein the plate-shaped body is made from a high-strength metal selected from the group consisting of titanium, stainless steel, V2A steel and chromium-vanadium steel.

13. Hand-held device according to claim 1, wherein the plate-shaped body is made of metal which is hardened after shaping.

14. Hand-held device according to claim 1, further comprises a disk containing a magnifying glass that can be inserted into a free space formed by the end indentation between the legs of the plate-shaped body.

15. Hand-held device according to claim 1, wherein the projecting tools are in the form of an Allen wrench, Phillips screwdriver and a flat-blade screwdriver.

16. Hand-held device according to claim 1, wherein a nail file is formed on an outer circumferential side of one leg of the plate-shaped body.

17. Hand-held device according to claim 1, where the ends of the legs are shaped as two different flat-blade screwdrivers, respectively.

18. Hand-held device according to claim 1, wherein ends of the legs are shaped as a Phillips screwdriver and as a flat-blade screwdriver, respectively.

19. Hand-held device according to claim 1, wherein any edges provided on an outer circumferential side defining the legs are blunt; whereas edges provided on an inner circumferential side defining the legs may be sharp to avoid injury to an operator of the device.

* * * * *